US006434353B1

(12) United States Patent
Kwak et al.

(10) Patent No.: US 6,434,353 B1
(45) Date of Patent: Aug. 13, 2002

(54) INK FEEDING VALVE OF A WET TYPE ELECTROPHOTOGRAPHIC PRINTER

(75) Inventors: Jin-geun Kwak; Kwang-ho No, both of Suwon (KR)

(73) Assignee: Samsung Electronics Co., Suwon (KR)

( * ) Notice: Subject to any disclaimer, the term of this patent is extended or adjusted under 35 U.S.C. 154(b) by 7 days.

(21) Appl. No.: 09/716,997

(22) Filed: Nov. 22, 2000

(30) Foreign Application Priority Data

Nov. 27, 1999 (KR) ..... 99-53287

(51) Int. Cl.[7] ..... G03G 15/10

(52) U.S. Cl. ..... 399/238; 222/449; 222/DIG. 1

(58) Field of Search ..... 399/238, 57; 222/587, 222/589, 21, 451, 453, 444, 449, 518, DIG. 1; 141/305, 344; 137/572

(56) References Cited

U.S. PATENT DOCUMENTS 3,072,302 A * 1/1963 Giovannoni et al. ..... 222/442
3,128,915 A * 4/1964 Matter ..... 222/156
3,749,289 A * 7/1973 Levy ..... 222/321.9
3,885,709 A * 5/1975 Levy ..... 222/133
4,015,755 A * 4/1977 Lerner et al. ..... 222/442
4,607,766 A * 8/1986 Jones ..... 222/386.5
5,019,250 A * 5/1991 Lorenzen ..... 210/104
5,248,847 A * 9/1993 Aoyama ..... 222/385
5,396,316 A * 3/1995 Smith ..... 396/282
6,155,457 A * 12/2000 Landa et al. ..... 222/327

* cited by examiner

*Primary Examiner*—Robert Beatty
(74) *Attorney, Agent, or Firm*—Robert E. Bushnell, Esq.

(57) ABSTRACT

An ink feeding valve of a wet type electrophotographic printer, capable of basically preventing operational error and incapability of valve due to ink attachment, includes: a valve body having a pipeline for interconnecting the concentrated ink tank with the developing solution tank; a rod assembly disposed in the pipeline of the valve body so as to be vertically moved for selectively opening/closing the pipeline; an elevating section for vertically moving the rod assembly; and a corrugated tube disposed in the pipeline of the valve body for partitioning the pipeline into an inner ink passage and an outside elevating section operating chamber, and for preventing ink flow into the elevating section operating chamber. Since the ink passage and the elevating section operating chamber are isolated from each other by the presence of a corrugated tube, the plunger and spring located in the elevating section operating chamber are efficiently operated without having problems caused due to ink attachment. Accordingly, ink can be consistently fed and operational problems avoided.

23 Claims, 7 Drawing Sheets

INK FEEDING VALVE OF A WET TYPE ELECTROPHOTOGRAPHIC PRINTER

CLAIM OF PRIORITY

This application makes reference to, incorporates the same herein, and claims all benefits accruing under 35 U.S.C. §119 from my application INK SUPPLY VALVE OF A LIQUID ELECTROPHOTOGRAPHIC PRINTER filed with the Korean Industrial Property Office on Nov. 27, 1999 and there duly assigned Serial No. 53287/1999.

BACKGROUND OF THE INVENTION

1. Technical Field

The present invention relates to an ink feeding system of a wet type electrophotographic printer and, more particularly, to an ink feeding valve having an improved structure for consistently feeding ink reserved in a concentrated ink tank to a developing solution tank.

2. Related Art

Generally, a wet type electrophotographic printer prints a desired image by forming an electrostatic latent image through the processes of: radiating a laser beam onto a photosensitive medium such as a photosensitive drum, a photosensitive belt, etc.; developing the electrostatic latent image with a developing solution of a certain color; and transferring the developed form to printed matter. Such electrophotographic color printers are mainly divided into wet type and dry type printers according to the kind of toner used. The wet type electrophotographic printer uses a developing solution which is composed of volatile liquid carrier and toner. The wet type electrophotographic printer has a higher print quality than the dry type electrophotographic printer which uses a power toner. Further, since the wet type electrophotographic printer does no harm in terms of toxic toner dust, the wet type electrophotographic printer is preferred to the dry type.

In the ink feeding valve described above, however, ink supply can vary due to different pressure of different ink amounts from the concentrated ink tank. Accordingly, the amount of ink supply can vary.

Further, in the ink feeding valve described above, there is or can be a problem of ink attachment to the inner side of the ink passage resulting in erroneous operation or, even worse, operational incapability. When such problems occur, the amount of ink supply becomes larger or smaller than required and, accordingly, the density of the developing solution is not maintained. Since such an inconsistent density of the developing solution has a negative effect on print quality, it is necessary to consistently feed concentrated ink. With the ink feeding valve described above, however, it is hard to adjust the density of the developing solution due to inconsistent concentrated ink supply.

SUMMARY OF THE INVENTION

The present invention has been developed to overcome the above-mentioned problems of the prior art and, accordingly, it is an object of the present invention to provide an ink feeding valve of a wet type electrophotographic printer capable of feeding consistent amounts of ink, regardless of pressure within a concentrated ink tank, by initially filling a certain volume of space with ink, before discharging ink to a developing solution tank.

It is another object of the present invention to provide an ink feeding valve of a wet type electrophotographic printer having a valve elevating section and an ink passage which are isolated from each other, and capable of operating efficiently without having ink attachment to the ink elevating section, and thereby capable of achieving consistent ink supply.

The above object is accomplished by an ink feeding valve of a wet type electrophotographic printer according to the present invention, including: a valve body having a pipeline interconnecting the concentrated ink tank with the developing solution tank; a rod assembly movable on the pipeline of the valve body within a certain vertical stroke for selectively opening/closing the pipeline; and an elevating section for vertically moving the rod assembly.

The valve body includes: an upper housing connected to a lower portion of the concentrated ink tank, and having a boss which has an ink inlet and which downwardly protrudes from the center of the upper housing; a bobbin having one end fixed to the upper housing, and the other end connected to the developing solution tank to define a pipeline; and an outer casing for covering the bobbin.

The rod assembly has first and second shutters disposed on upper and lower portions, respectively, of the rod to open upper and lower openings, respectively, of the pipeline alternately according to the vertical movement of the rod. When the upper opening of the pipeline is opened by the first shutter, the lower opening of the pipeline is closed by the second shutter. Accordingly, during the ink supply, ink flows from the concentrated ink tank to the pipeline in a certain volume sufficient to fill the pipeline, and then flows to the developing solution tank when the lower opening of the pipeline is opened by the de-elevating movement of the rod assembly. As a result, ink can be supplied in a consistent amount and in correspondence to the volume of the pipeline. In other words, ink can be consistently supplied from the concentrated ink tank, regardless of the amount of ink held in the concentrated ink tank.

The elevating section includes: an operation bar integrally connected to the center portion of the rod, a plunger disposed in the bobbin so as to be vertically moved along the inner circumferential surface of the bobbin, and having a stepped portion formed on the inner side for supporting both ends of the operation bar; a solenoid disposed between the outer casing and the bobbin for elevating the plunger by receiving electric current; a solenoid head formed on the upper inner side of the bobbin at a certain distance from the plunger for restricting movement of the plunger and a spring disposed between the upper housing and the operation bar for elastically biasing the operation bar downwardly.

Another object is accomplished by an ink feeding valve of a wet type electrophotographic printer according to the present invention, including a corrugated tube disposed on the pipeline of the valve body for partitioning the pipeline into an inside ink passage and an outside elevating section operating chamber on which the elevating section is mounted, thereby preventing flow of ink into the elevating section operating chamber.

Since the corrugated tube separately defines the ink passage and elevating section operating chamber, the elevating section is operated without having ink attachment thereto. Accordingly, the abnormality or undesirable operation due to ink attachment to the elevating section can be basically prevented.

An upper end of the corrugated tube is connected to an end of the boss of the upper housing, while a lower end thereof is fitted into a projection section inwardly protruding from the bobbin. Further, the corrugated tube includes two inwardly folded portions. These two inwardly folded portions are formed in symmetrical relation with each other by the operation bar located therebetween. When one folded portion contracts, the other extends. Further, it is preferable that the corrugated tube has such a diameter that an extreme inner end of the folded portion is spaced from the rod by at least 2 mm.

According to another preferred embodiment of the present invention, an ink feeding valve of a wet type electrophotographic printer includes: an upper housing connected to the lower portion of the concentrated ink tank, and having a boss downwardly projecting therefrom, the boss having an ink inlet formed on the center thereof for forming the ink passage; a bobbin having one end fixed to the upper housing and the other end connected to the developing solution tank for forming a pipeline; a rod having a first shutter and a second shutter disposed on the upper and lower portions, respectively, of the rod for closing upper and lower openings of the ink passage alternately, the rod vertically movable within the ink passage; an operation bar integrally connected with the center portion of the rod; a plunger vertically movable along the inner circumferential surface of the bobbin, and having a stepped portion for supporting both ends of the operation bar; a solenoid disposed outside the bobbin for upwardly driving the plunger by receiving electric current; a solenoid head disposed in the upper inner side of the bobbin at a certain distance from the plunger for limiting the movement of the plunger; a spring disposed between the upper housing and the operation bar for elastically biasing the operation bar downwardly; and a corrugated tube vertically extending between an end of a boss of the upper housing and the projection inwardly protruding from the lower side of the bobbin for preventing ink flow into the place where the plunger and spring are disposed.

According to still another preferred embodiment of the present invention, an ink feeding valve of a wet type electrophotographic printer includes: an upper housing connected to the lower portion of the concentrated ink tank, and having a boss downwardly projecting therefrom, the boss having an ink inlet formed on the center thereof for defining an ink passage; a bobbin having one end fixed to the upper housing, and the other end connected to the developing solution tank for forming a pipeline; a rod having a first shutter and a second shutter disposed on the upper and lower portions, respectively, of the ink passage for closing the upper and lower openings of the ink passage alternately, the rod being vertically movable within the ink passage; a plunger-operation bar integration connected to the center portion of the rod, and having a plunger portion integrally formed on both ends thereof; a solenoid disposed outside the bobbin for upwardly driving the plunger by receiving electric current; a spring disposed between the upper housing and the operation bar for elastically biasing the operation bar downwardly; and a corrugated tube vertically extending between an end of boss of the upper housing and a fixing member formed on the lower side of the bobbin for preventing ink flow into the space in which the plunger of the plunger-operation bar integration and the spring are disposed.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
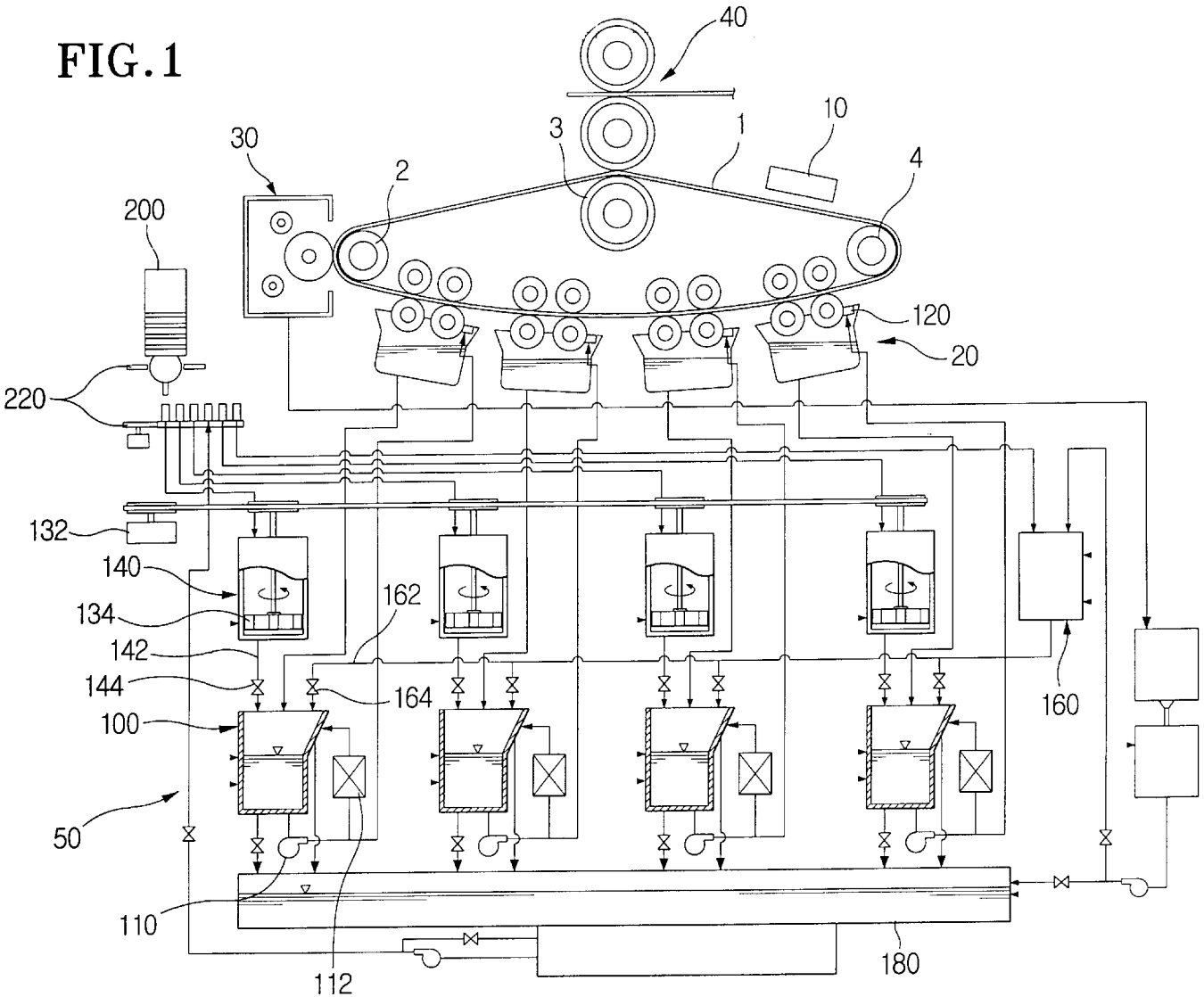
FIG. 1 is a schematic view of a developing solution feeding apparatus of a wet type electrophotographic printer.

FIG. 1 is a schematic view of a developing solution feeding apparatus of a wet type electrophotographic printer.

As shown in FIG. 1, the printer includes a photosensitive belt 1 disposed along an endless track, and first, second and third rollers 2, 3 and 4, respectively, for rotating the photosensitive belt 1 on a given path. Around the photosensitive material 1, there is disposed a charging unit 10 for charging the photosensitive belt 1 with a certain electric phase, an exposure unit (not shown) for forming the latent electrostatic image on the photosensitive belt 1 by projecting light beams varied in accordance with the electric data of the area to be printed, a developing unit 20 for developing the latent electrophotographic image by jetting the developing solution onto the photosensitive belt 1, a drying unit 30 for eliminating unnecessary liquid carrier from the developed image, a transferring/fixing unit 40 for transferring the image on the photosensitive belt 1 to the printed matter, and a developing solution feeding unit 50 for feeding a certain concentration of developing solution to the developing unit 20. The developing solution is composed of concentrated ink containing power toner and liquid carrier. The density of the toner ranges from 2 to 4 w %, and the toner contains pigments representing yellow, magenta, cyan and black.

The developing solution feeding unit 50 includes a plurality of developing solution tanks 100 for holding developing solutions of respective colors (four colors, for example) to be fed to the developing unit 20, a plurality of jetting nozzles 120 for jetting developing solution from the respective developing solution tanks 100 into developing gaps of the developing unit 20, a plurality of concentrated ink tanks 140 for holding concentrated ink of the respective colors to be fed to the developing solution tanks 100, a carrier tank 160 for holding carrier, a waste developing solution tank 180 for collecting waste developing solution from the developing solution tanks 100, and a developing solution refilling/waste developing solution collecting section 220 for refilling the concentrated ink tanks 140 or the carrier tank 160 with the concentrated ink or the carrier from refill cartridges 200, and also for collecting waste developing solution from the waste tank 180 in the empty refill cartridges 200.

The developing solution tanks 100 and the jetting nozzles 120 are connected by pipes on which developing solution pumps 110 are respectively connected. Lines are branched from the respective pipes so as to be connected to developing solution density measuring sensors 112 and with the developing solution tanks 100, respectively.

Further, the concentrated ink tanks 140 include agitators 134 driven by single driving sources 132, respectively, for agitating the concentrated ink in the concentrated ink tanks 140. The concentrated ink tanks 140 are connected to the developing solution tanks 100 via first pipes 142, respectively, and the carrier tank 160 is connected to the developing solution tanks 100 via second pipes 162, respectively. On the first and second pipes 142 and 162, respectively, ink feeding valves 144 and carrier valves 164 are connected to selectively open/close the first and second pipes 142 and 162, respectively, thereby selectively feeding a certain amount of concentrated ink or carrier to the developing solution tanks 100. Accordingly, the developing solution in the developing solution tanks 100 is maintained at the desired density.

The ink feeding valves 144 are driven on/off by a control signal from a control section (not shown) so as to selectively open/close the first pipes 142, and permit concentrated ink from the concentrated ink tanks 140 to flow into the developing solution tanks 100, respectively.

Figure 2:
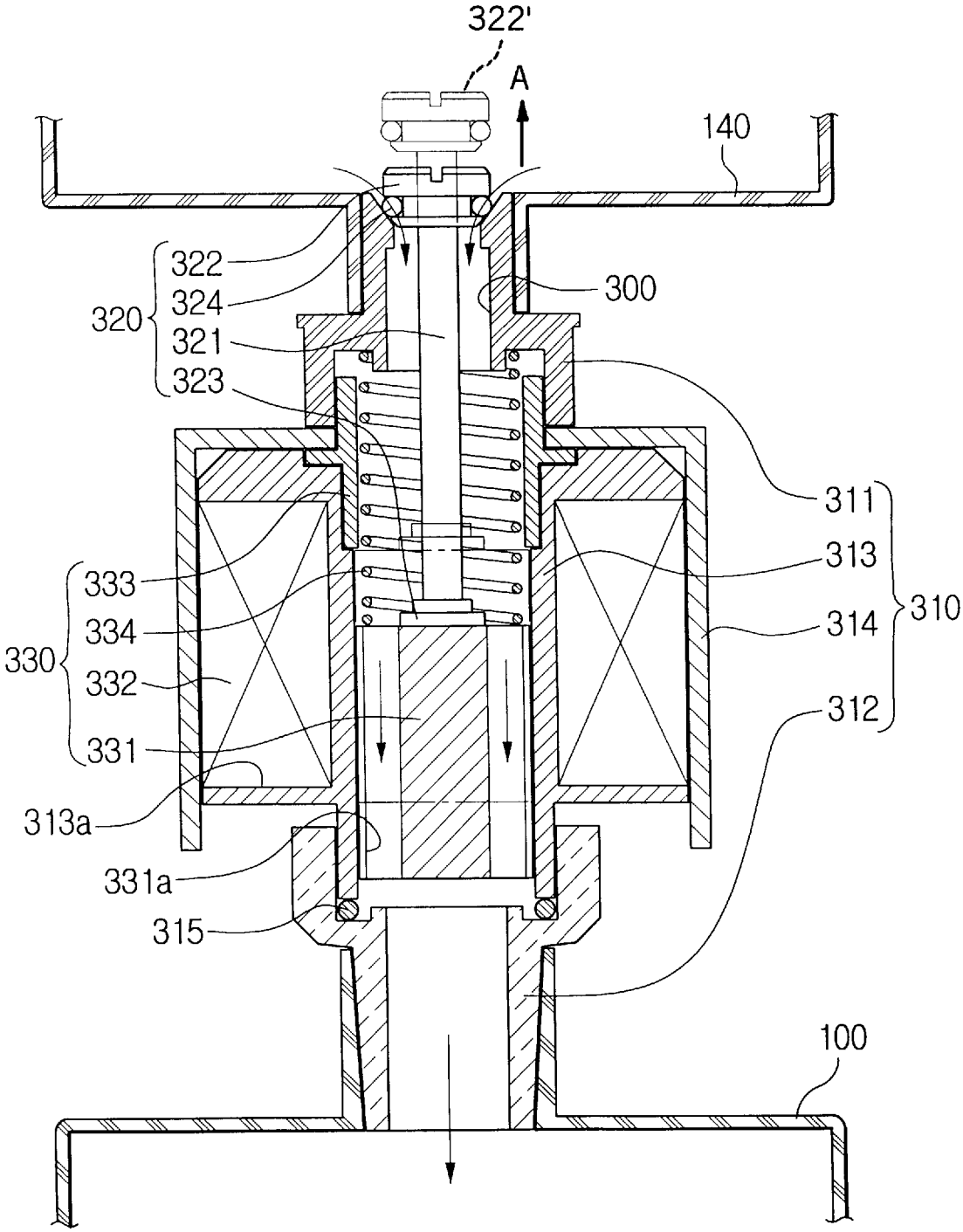
FIG. 2 is a sectional view showing the structure and operation of an ink feeding valve.

FIG. 2 is a sectional view showing the structure and operation of an ink feeding valve.

As shown in FIG. 2, the ink feeding valve includes a valve body 310 having an ink passage 300 for interconnecting the concentrated ink tank 140 with the developing solution tank 100. Within the ink passage 300 of the valve body 310, a rod assembly 320 is disposed so as to be moved at a certain stroke to selectively open/close the ink passage 300. The rod assembly 320 is moved upward/downward by an elevating section 330.

The valve body 310 includes: upper and lower housings 311 and 312, respectively, having fitting sections to be fitted in the concentrated ink tank 140 and the developing solution tank 100, respectively, a bobbin 313 connected between the upper and lower housings 311 and 312, respectively, and having a certain empty area 313*a* formed at an outside portion thereof; and an outer casing 314 mounted on the outer side of the empty area 313*a* of the bobbin 313. Further, the connective area between the upper housing 312 and the bobbin 313 is sealed by a first sealing member 315.

The rod assembly 320 includes a rod 321, a shutter 322 for tightly sealing an opening of the upper housing 311, a connecting section 323 connected to the lower portion of the rod 321, and a second sealing member 324 disposed at the shutter 322 for maintaining a sealing status thereof.

The elevating section 330 includes: a plunger 331 which has a plurality of ink holes 331*a*, and which is connected to the connecting section 323 of the rod 321; a solenoid 332 mounted within the empty area 313*a* of the bobbin 313 for elevating the plunger 331 within the ink passage 300 by electric current; a solenoid head 333 disposed on the inner upper portion of the bobbin 313 at a certain distance from the plunger 331 for limiting the movement of the plunger 331; and a spring 334 disposed between the upper housing 311 and the plunger 331 for elastically biasing the plunger 331 downwardly.

In the ink feeding valve constructed as above, when there is no electric current supply to the solenoid 332, the plunger 331 is biased downward by the spring 334, and the opening of the upper housing 311 is closed by the shutter 322 of the rod 321. Accordingly, ink from the concentrated ink tank 140 is not supplied.

Conversely, when electric current is supplied to the solenoid 332, the plunger 331 is elevated against the elasticity of the spring 334, and accordingly, the shutter 322 of the rod 321 is elevated in a direction indicated by arrow A to a position 322' so as to open the opening of the upper housing 311. As a result, ink from the concentrated ink tank 140 is supplied to the developing solution tank 100 through the ink passage 300. The ink passage 300 is opened for a certain period time until a required amount of ink is supplied, and then cutting off of the electric current to the solenoid 332 causes the plunger 331 to move downward due to the returning elasticity of the spring 334, and the opening of the upper housing 311 is closed by the shutter 322, whereby the ink supply is stopped.

In the ink feeding valve described above, however, since the ink supply is adjusted by adjusting the opening time of the valve, ink supply varies due to different pressure of different ink amounts from the concentrated ink tank 140. Accordingly, the amount of ink supply varies, even during the same valve opening hour, and density of the developing solution is not maintained.

Further, in the ink feeding valve described above, the plunger 331 and the spring 334, which elastically biases the plunger 331, are exposed to the ink passage 300, which causes a problem of ink attachment to the inner side of the ink passage 300 and error in the operation of the plunger 331 or the spring 334 or, even worse, operational incapability. When such problems occur, the amount of ink supply becomes larger or smaller than required and, accordingly, the density of the developing solution is not maintained.

Since such an inconsistent density of the developing solution has a negative effect on print quality, it is necessary to consistently feed concentrated ink. With the ink feeding valve described above, however, it is hard to adjust the density of the developing solution due to inconsistent concentrated ink supply.

Figure 3:
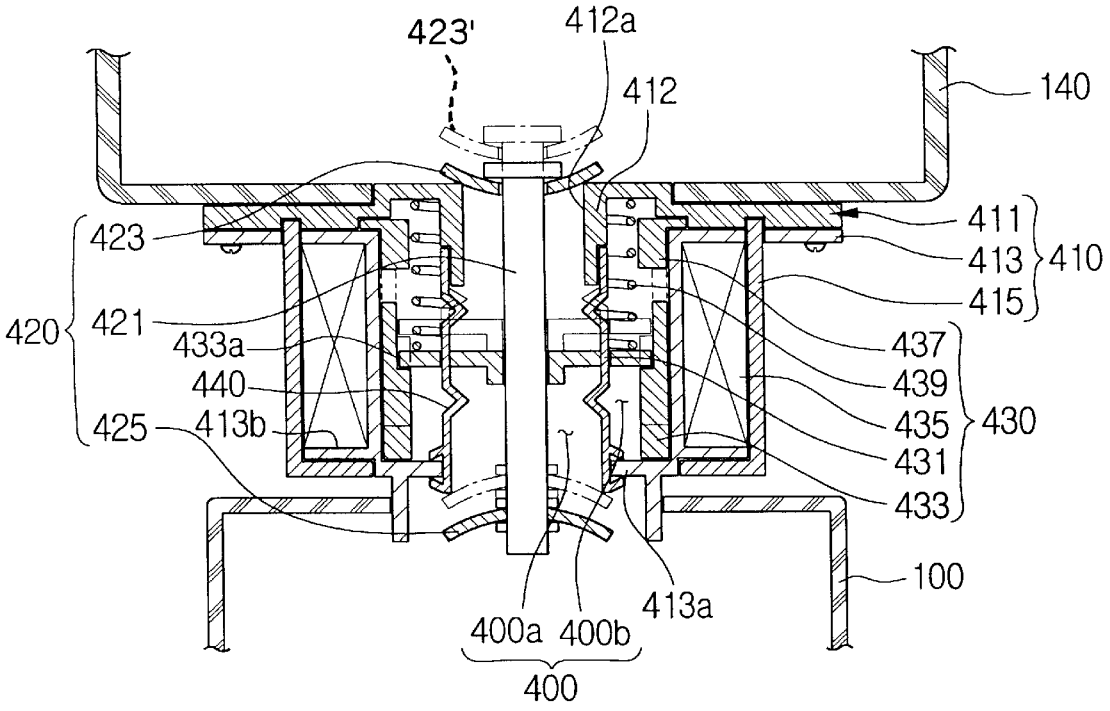
FIG. 3 is a sectional view showing the structure and operation of an ink feeding valve according to a first preferred embodiment of the present invention.
Figure 4:
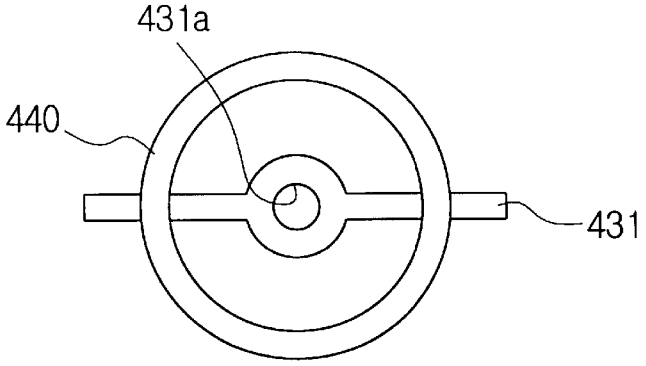
FIG. 4 is a plan view showing an operation bar of the ink feeding valve of FIG. 3, and the connection between the operation bar and a corrugated tube.

FIG. 3 is a sectional view showing the structure and operation of an ink feeding valve according to a first preferred embodiment of the present invention, and FIG. 4 is a plan view showing an operation bar of the ink feeding valve of FIG. 3.

As shown in FIG. 3, the ink feeding valve according to the first preferred embodiment of the present invention includes a valve body 410, a rod assembly 420, an elevating section 430, and a corrugated tube 440.

The valve body 410 includes a pipeline 400 for interconnecting the concentrated ink tank 140 with the developing solution tank 100. The rod assembly 420 is vertically movable within the pipeline 400 of the valve body 410, and selectively opens/closes the pipeline 400. Further, the elevating section 430 vertically moves the rod assembly 420 within a certain stroke. The corrugated tube 440 partitions the pipeline 400 into an inside ink passage 400*a* and an outside elevating section operating chamber 400*b* where the elevating section 430 is located. Accordingly, ink does not flow into the elevating section operating chamber 400*b*, and the elevating section 430 is always operated efficiently without having a problem due to ink attachment.

Hereinafter, the respective elements will be described in greater detail.

The valve body 410 includes an upper housing 411 fit into the lower portion of the concentrated ink tank 140, and a bobbin 413 having one end fixed to the upper housing 411 and the other end connected to the developing solution tank 100. On the center portion of the upper housing 411, a boss 412 is formed. The boss 412 includes an ink inlet 412*a* for forming the ink passage 400*a*. Further, the bobbin 413 has a projecting section 413*a* inwardly protruding from the lower inner side thereof, and an empty area formed on the outside. The valve body 410 may include an outer casing 415 disposed around the outer side of the bobbin 413. The upper end of the outer casing 415 is fastened to the upper housing 411, while the lower end thereof is fitted over the lower side of the bobbin 413.

The rod assembly 420 includes a rod 421, first shutter 423 formed on the upper portion of the rod 412 for closing the ink inlet 412*a* of the upper housing 411, and second shutter 425 for closing a lower opening when the ink inlet 412*a* of the upper housing 411 is opened by the elevating movement of the rod 421, and for defining a certain volume of space in the ink passage 400*a*. The rod assembly 420 is vertically moved by the elevating section 430 for selectively opening the ink passage 400*a,* thereby permitting ink supply to the developing solution tank 100. Since ink is fed to the developing solution tank 100 through the lower opening of the ink passage 400*a* after a certain amount of ink fills the space of the ink passage 400*a,* a consistent amount of ink can be fed at all times, regardless of the amount of ink in the concentrated ink tank 140. The elevating section 430 includes an operation bar 431 integrally disposed around the center portion of the rod 421, plunger 433 movably disposed in the elevating section operating chamber 400*b* so as to be vertically moved along the inner circumferential surface of the bobbin 413, solenoid 435 for elevating the plunger 433, solenoid head 437 for restricting movement of the solenoid 435, and spring 439 for de-elevating the operation bar 413 to an initial position. As shown in FIGS. 3 and 4, the operation bar 431 includes a hole 431*a* formed in its center portion to which the rod 421 is press-fitted, while both ends thereof protrude toward the elevating section operating chamber 400*b* after being passed through the corrugated tube 440. A stepped section 433*a* is formed at a certain location of the inner portion of the plunger 433, and both ends of the operation bar 431 are supported on stepped section 433*a*. Accordingly, by virtue of the vertical movement of the plunger 433, the operation bar 431 and the rod assembly 420 are elevated/de-elevated. Further, the solenoid 435 is disposed in the empty area 413*b* of the bobbin 413, and the solenoid head 437 is mounted on the upper inner side of the bobbin 413 at a certain distance from the plunger 433. The spring 439 is disposed around the outer side of the boss 412 of the upper housing 411 and is connected to the operation bar 431 for elastically biasing the operation bar 431 downward.

Meanwhile, an upper end of the corrugated tube 440 is connected to the end of the boss 412 of the upper housing 411, while the lower end of the corrugated tube 440 is fitted to the projecting section 413*a* inwardly protruding from the lower side of the bobbin 413. Accordingly, the elevating section operating chamber 400*b* is isolated from the ink passage 400*a*. The corrugated tube 440 includes at least two inwardly folded portions which are formed in a symmetrical relationship to each other with the operation bar 431 located therebetween. Accordingly, when one folded portion contracts, the other extends. It is preferable that the corrugated tube 440 has such a diameter that an extreme inner end of the folded portion is spaced from the rod 421 by at least 2 mm, although such arrangement is not strictly limited thereto. In this embodiment, the corrugated tube 440 is formed to have a diameter that allows a 4 mm gap between the extreme inner end of the folded portion and the rod 421 for the most efficient ink supply.

The operation of the ink feeding valve constructed as above according to the present invention will be described below.

When there is no electric current flowing through the solenoid 435, the operation bar 431 and the plunger 433 are pushed downward by the elastic returning force of the spring 439 so as to be in the lower position. Accordingly, the ink inlet 412*a* of the upper housing 411 is closed by the shutter 423 of the rod 421, and ink from the concentrated ink tank 140 is not supplied.

Conversely, when electric current flows to the solenoid 435, the plunger 433 is moved upward against the elasticity of the spring 439, and accordingly, the shutter 423 of the rod 421 is elevated to a position 423' so as to open the ink inlet 412*a* of the upper housing 411. Further, by virtue of movement of the second shutter 425 of the rod 421, the lower opening of the ink passage 400*a* is closed. Accordingly, ink is fed from the concentrated ink tank 140 so as to firstly fill the ink passage 400*a* to a certain level before being fed to the developing solution tank 100. Then, when the lower opening of the ink passage 400*a* is opened by the de-elevating movement of the rod assembly 420, ink is fed from the ink passage 400*a* to the developing solution tank 100. In such a situation, since ink has a high density and viscosity, ink may become attached to the inner wall of the corrugated tube 440 while being supplied through the ink passage 400*a,* forming a sludge, etc. on the inner wall of the corrugated tube 440. Since the elevating section operating chamber 400*b* is isolated from the ink passage 400*a* by the corrugated tube 440, ink does not flow into the elevating section operating chamber 400b, and accordingly, the plunger 433 and spring 439 are operated efficiently without having a problem caused due to ink attachment.

Here, the de-elevating movement of the rod assembly 420 is performed by cutting off electric current supplied to the solenoid 435. As the plunger 433 is moved downward by the elastic recovering force of the spring 439, the ink inlet 412*a* of the upper housing 411 is re-closed by the first shutter 423 of the rod 421, and ink supply is stopped.

Figure 5:
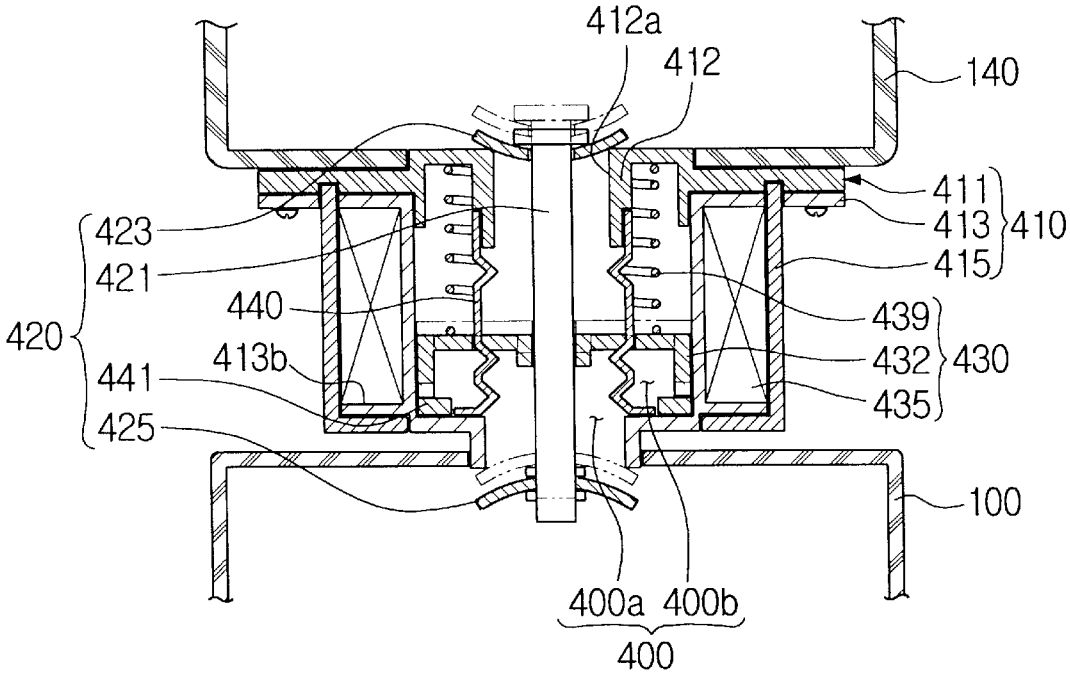
FIG. 5 is a sectional view showing the structure and operation of an ink feeding valve according to a second preferred embodiment of the present invention.
Figure 6:
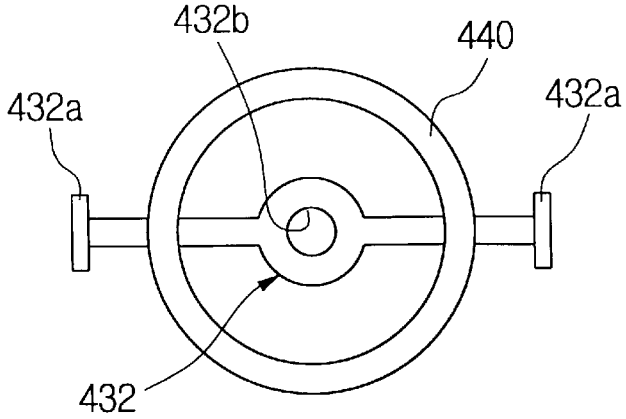
FIG. 6 is a plan view showing the operation bar of the ink feeding valve of FIG. 5, and the connection between the operation bar and the corrugated tube.

FIG. 5 is a sectional view showing the structure and operation of the ink feeding valve according to the second preferred embodiment of the present invention, and FIG. 6 is a plan view showing the operation bar integrally formed with the plunger in the ink feeding valve of FIG. 5. For convenience in explaining this embodiment, elements identical to those of the first embodiment will be given the same reference numerals throughout, and any repetitious description will be omitted as much as possible, while focusing on the unique features of this embodiment.

As shown in FIG. 5, the basic structure of the ink feeding valve, including valve body 410, rod assembly 420, elevating section 430 and corrugated tube 440, is identical to that of the first preferred embodiment, with the exception that the elevating section 430 further includes a plunger-operation bar integration 432 which results in a simpler structure of the ink feeding valve.

More specifically, the elevating section 430 of the ink feeding valve according to this preferred embodiment includes a plunger-operation bar integration 432 integrally fitted around the center portion of the rod 421 in such a manner that both ends thereof are located in the elevating section operating chamber 400*b* after being passed through the corrugated tube 440. The plunger-operation bar integration 432 has a bent plunger portion 432*a* (see FIG. 6) integrally formed on both ends of the plunger-operation bar integration 432, a solenoid 435 is mounted in the outside empty space 413*b* of the bobbin 413 for elevating the plunger-operation bar integration 432 when receiving electric current, and a spring 439 is disposed between the upper housing 411 and the plunger-operation bar integration 432 for elastically biasing the plunger-operation bar integration 432 downward.

As shown in FIGS. 5 and 6, the plunger-operation bar integration 432 includes a hole 432*b* to which the rod 421 is press-fitted. The second shutter 425 disposed around the lower portion of the rod 421 closes the lower opening of the bobbin 413 when the rod 421 is elevated. Further, according to this preferred embodiment, the lower portion of the corrugated tube 440 is fixed on the inner horizontal portion of the bobbin 413 by a separate fixing member 441.

In the ink feeding valve constructed as above according to the second preferred embodiment of the present invention, as in the first preferred embodiment, when electric current is not permitted to flow through the solenoid 435, the plunger-operation bar integration 432 is pushed to a lower position by the spring 439, and the ink passage 400*a* is closed. When electric current flows through the solenoid 435, the plunger-operation bar integration 432 is elevated to open the ink passage 400*a*, and ink is thereby supplied. In this situation also, ink is supplied to the developing solution tank 100 through the lower opening of the ink passage 400*a* which is opened by the de-elevating movement of the rod assembly 420, and only after a certain amount of ink fills the space of the ink passage 400*a*. Accordingly, regardless of the amount of ink in the concentrated ink tank 140, the ink supply is consistent at all times. Further, ink is supplied only through the ink passage 400*a* which is isolated from the elevating section operating chamber 400*b* by the corrugated tube 440, and does not flow to the plunger portion 432*a* and the spring 439 which are located in the elevating section operating chamber 400*b*. Accordingly, operational error and operational incapability of the elevating section 430 caused by ink attachment are prevented.

Description of the structure and operational effects of the ink feeding valve according to this embodiment are the same as in the first preferred embodiment of the present invention and will be omitted.

Figure 7:
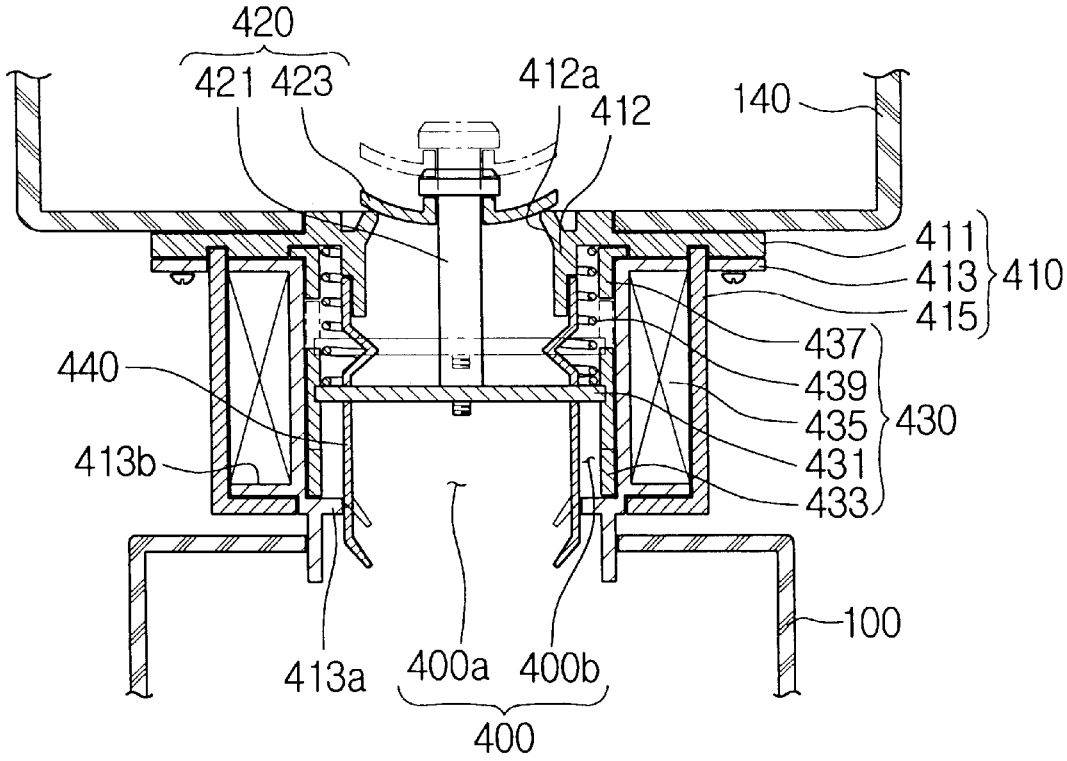
FIG. 7 is a sectional view showing the structure and operation of an ink feeding valve according to a third preferred embodiment of the present invention.

FIG. 7 shows the structure and operation of the ink feeding valve according to the third preferred embodiment of the present invention. As shown in FIG. 7, the ink feeding valve according to the third preferred embodiment has almost the same structure as the ink feeding valve of the first preferred embodiment, except for the fact that the lower portion of the corrugated tube 440 is not fixed on another member (as seen in FIG. 5), but is supported by its contact with the projection 413*a* of the bobbin 413. Accordingly, elements identical to those of the first preferred embodiment will be given the same reference numerals throughout, and any repetitious description will be omitted. The operation and effect of the ink feeding valve according to the third preferred embodiment is also almost the same as the operation of the above described first and second embodiments, in which the elevating section operating chamber 400*b* having the plunger 433 and the spring 439 is isolated from the ink passage 400*a* by the corrugated tube 440, thereby basically preventing any possible operational error and operational incapability of the plunger 433 and the spring 439 due to ink attachment.

Figure 8:
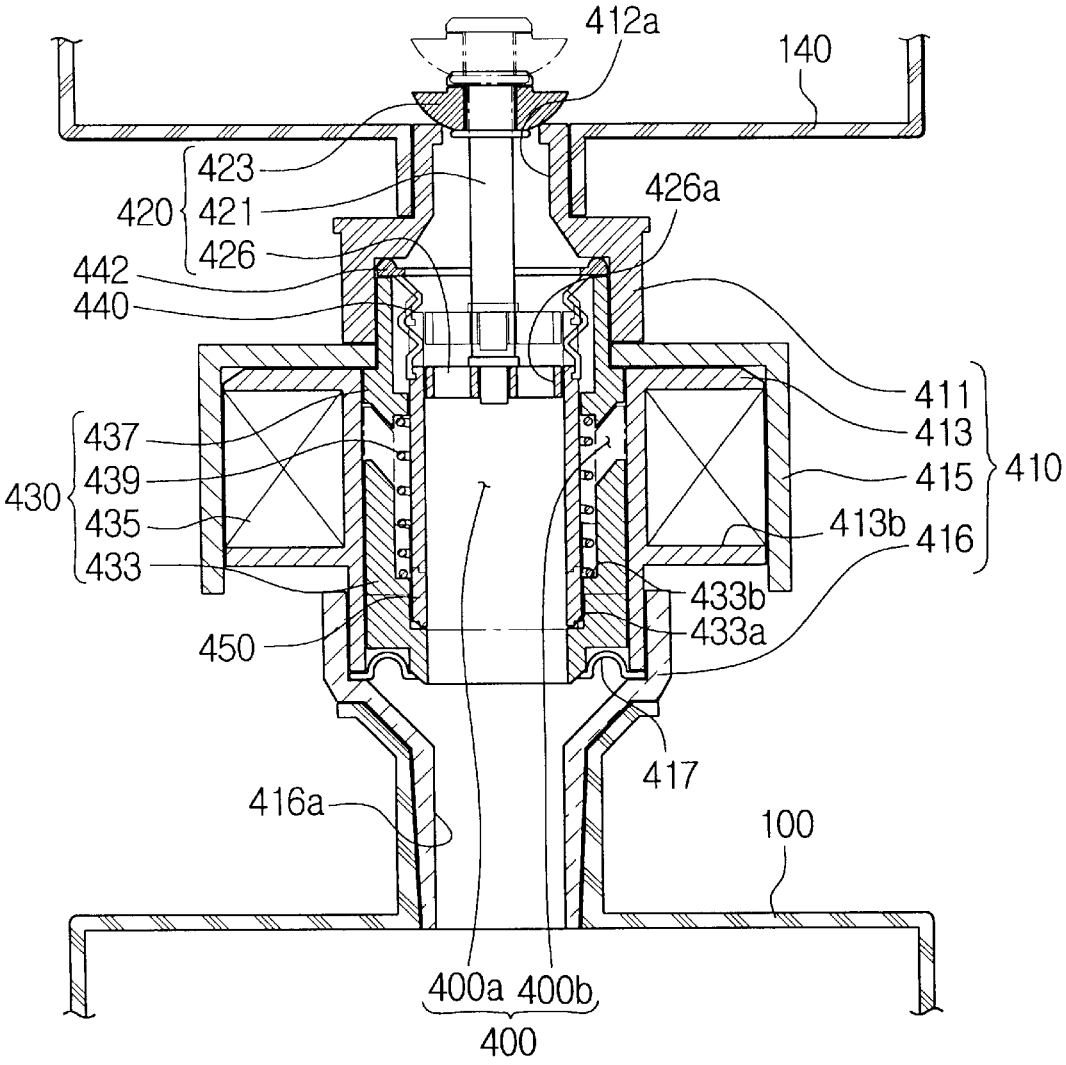
FIG. 8 is a sectional view showing the structure and operation of an ink feeding valve according to a fourth preferred embodiment of the present invention.

FIG. 8 is a sectional view showing the structure and operation of the ink feeding valve according to the fourth preferred embodiment of the present invention.

As shown in FIG. 8, the ink feeding valve according to the fourth preferred embodiment includes a valve body 410 having a pipeline 400 for interconnecting the concentrated ink tank 140 with the developing solution tank 100, rod assembly 420 disposed on the pipeline 400 of the valve body 410 so as to be vertically moved for selectively opening/closing the pipeline 400, elevating section 430 for vertically moving the rod assembly, cylinder partition 450 downwardly extending from the lower portion of the rod assembly 420 for partitioning the pipeline 400 into an inside ink passage 400*a* and an outside elevating section operating chamber 400*b*, and corrugated tube 440 for preventing ink flow to the elevating section operating chamber 400*b*.

The valve body 410 includes upper and lower housings 411 and 416 having fitting portions which are fit into the concentrated ink tank 140 and the developing solution tank 100, respectively, a bobbin 413 connected between the upper and lower housings 411 and 416, and an outer casing 415 disposed around the outer side of the bobbin 413 in such a manner as to cover the bobbin 413. The upper and lower housings 411 and 416, respectively, include ink inlet and outlet 412*a* and 416*a*, respectively, formed thereon. An empty space is formed around the outer circumference of the bobbin 413. Further, a sealing pad 417 is disposed between the lower end of the bobbin 413 and the connecting portion of the lower housing 416, respectively, to maintain sealing status.

The rod assembly 420 includes a rod 421, shutter 423 disposed around the upper portion of the rod 421 for closing the ink inlet 412*a* of the upper housing 411, and connecting portion 426 which is formed on the lower portion of the rod 421 and has a plurality of ink passing holes 426*a*.

The elevating section 430 includes a plunger 433 movably disposed in the elevating section operating chamber 400*b* so as to be vertically moved along the inner circumferential surface of the bobbin 413, solenoid 435 for elevating the plunger 433, solenoid head 437 formed around the upper side of the elevating section operating chamber 400*b* at a certain distance from the plunger 433 for restricting the movement of the solenoid 435, and spring 439 disposed between the plunger 433 and the solenoid head 437 for elastically de-elevating the plunger 433. First and second stepped portions 433*a* and 433*b* are formed on the plunger 433. The lower end of the cylinder partition 450 is supported on the first stepped portion 433*a*. The upper end of the cylinder partition 450 is fixed to the connecting portion 426 of the rod assembly 420. Accordingly, as the plunger 433 is elevated, the cylinder partition 450 and the rod assembly 420 are elevated to open the ink passage 400*a*, and ink is supplied to the developing solution tank 100. Meanwhile, the second stepped portion 433*b* of the plunger 433 supports the lower end of the spring 439, while the upper end of the spring 439 is supported by the solenoid head 437.

The corrugated tube 440 extends vertically between the upper portion of the cylinder partition 450 and the upper portion of the solenoid head 437 for preventing ink flow into the elevating section operating chamber 400*b*. Accordingly, while ink is supplied through the ink inlet 412*a* of the upper housing 411, ink does not flow into the elevating section operating chamber 400*b*, but it does flow into the developing solution tank 100 through the ink passage 400*a*. Further, there is a sealing member 442 integrally disposed around the upper end of the corrugated tube 440 for maintaining sealing status.

The operation of the ink feeding valve constructed as described above according to the fourth preferred embodiment is the same as the operation of the ink feeding valve of the other embodiments of the present invention described above, in which operational error or incapability of the plunger 433 and the spring 439 due to ink attachment is basically prevented by the structure wherein the elevating section operating chamber 400*b* accommodates the plunger 433 and the spring 439 is isolated from the ink passage 400*a* by the cylinder partition 450 and the corrugated tube 440.

Figure 9:
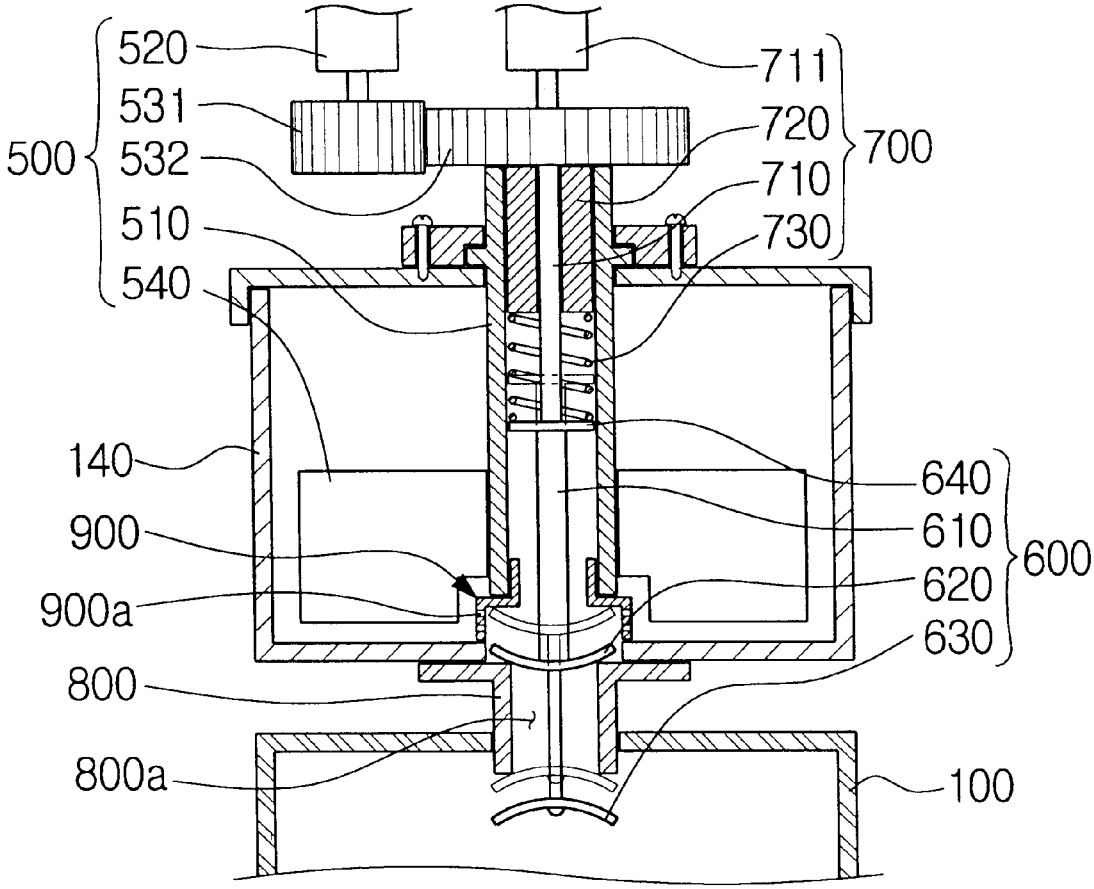
FIG. 9 is a sectional view showing the structure and operation of an ink feeding valve according to a fifth preferred embodiment of the present invention.

FIG. 9 is a sectional view showing the structure and operation of the ink feeding valve according to the fifth preferred embodiment of the present invention.

As shown in FIG. 9, the ink feeding valve according to the fifth preferred embodiment of the present invention has a structure in which an elevating section 700 for vertically moving the rod assembly 600 is provided in the hollow rotational shaft 510 of an agitator 500 in the concentrated ink tank 140 so as to isolate the elevating section 700 from the ink passage 400*a*. This will be described in greater detail below.

The agitator 500 includes a hollow rotational shaft 510 which rotatably stands upright in the concentrated ink tank 140, a motor 520 which is a driving source for rotating the hollow rotational shaft 510, a transmitting section for transmitting the driving force of the motor 520 to the hollow rotational shaft 510, and an agitator fan 540 disposed around the lower side of the hollow rotational shaft 510. The driving force transmitting section includes a driving gear 531 disposed around a shaft of the motor 520, and a driven gear 532 disposed around the upper portion of the hollow rotational shaft 510 so as to be engaged with the driving gear 531.

Further, between the concentrated ink tank 140 and the developing solution tank 100, a secondary tank 800 having a certain volume is formed to serve as a valve body, and the rod assembly 600 is disposed in the empty space of the hollow rotational shaft 510 so as to be vertically moved within a certain stroke for selectively opening/closing the ink passage 800*a* of the secondary tank 800.

The rod assembly 600 includes a first shutter 620 located at a certain position of the rod 610 for closing the upper opening of the secondary tank 800, and a second shutter 630 located at the lower end of the rod 610 for closing the lower opening of the secondary tank 800 during the elevation of the rod 610. Further, on the upper end of the rod 610, a guiding plate 640 is integrally formed for guiding the vertical movement of the rod 610.

The elevating section 700 includes a solenoid 711 having an operation bar 710 protruding from the guiding plate 640 of the rod assembly 600 to the outside through the center of the driven gear 532 so as to be on/off driven by the signal from a control section (not shown), a guiding member 720 disposed within the hollow rotational shaft 510 for guiding the movement of the operation bar 710, and a spring 730 disposed between the guiding member 720 and the guiding plate 640 for elastically biasing the rod assembly 600 downwardly.

Further, between the lower end of the hollow rotational shaft 510 and the bottom surface of the concentrated ink tank 140, a cylindrical ink guiding member 900 having a plurality of holes 900*a* formed on the cylindrical surface thereof is disposed.

In the ink feeding valve constructed as above according to the fifth preferred embodiment of the present invention, when the solenoid 711 is in the off-state, as shown by a solid line in FIG. 9, the rod assembly 600 is in the lower position since the rod assembly 600 is pushed downward by the elasticity of the spring 730. Accordingly, the first shutter 620 of the rod assembly 600 comes into tight contact with the upper opening of the secondary tank 800, the ink passage 800*a* is closed, and ink is not supplied. As the motor 520 is driven, the agitator 500 agitates concentrated ink in the concentrated ink tank 140 while being rotated.

When ink supply is required, a corresponding signal is applied to the solenoid 711 from the control section (not shown), turning on the solenoid 711. Accordingly, as shown in FIG. 9, the rod assembly 600 is elevated against the elasticity of the spring 730, and first shutter 620 opens the ink passage 800*a*. In this situation, the second shutter 630 closes the lower opening of the secondary tank 800, and ink in the concentrated ink tank 140 is supplied to the opened ink passage 800*a* of the secondary tank 800 through the holes 900*a* of the ink guiding member 900. In such a situation, as the solenoid 711 is turned to the off-state, the rod assembly 600 is de-elevated by the elasticity of the spring 730, and the second shutter 630 is de-elevated in unison to open the lower opening of the secondary tank 800. Accordingly, the first ink supply in the secondary tank 800 is finally supplied to the developing solution tank 100. Here, the agitator 500 may be continuously driven to agitate concentrated ink.

In the fifth embodiment also, since ink is supplied to the developing solution tank 100 only after a certain amount of ink fills the ink passage 800*a*, ink can be supplied consistently. Further, the elevating section is isolated from the ink passage, and accordingly, operational error or incapability due to ink attachment is basically prevented. Further, when electric current is cut off, since the shutter is subjected to water pressure in addition to the elasticity of the spring, the sealing status thereof is much increased.

As described above, according to the present invention, since the operation chamber that accommodates the elevating section, such as the plunger and the spring, is isolated from the ink passage by a corrugated tube, ink does not flow to the elevating section operating chamber. Accordingly, operational error or incapability of the elevating section due to ink attachment does not occur. As a result, the problems due to ink attachment, such as operational error or incapability of the elevating section, are basically prevented, and ink can be consistently supplied.

As stated above, the preferred embodiments of the present invention are shown and described. Although the preferred embodiments of the present invention have been described, it is understood that the present invention should not be limited to these preferred embodiments, but various changes and modifications can be made by one skilled in the art within the spirit and scope of the present invention, as hereinafter claimed.

What is claimed is:

1. An ink feeding valve of a wet type electrophotographic printer for selectively feeding concentrated ink reserved in a concentrated ink tank to a developing solution tank, comprising:

a valve body having a pipeline interconnecting the concentrated ink tank and the developing solution tank;

a rod assembly movable on the pipeline of the valve body within a predetermined vertical stroke for selectively opening and closing the pipeline; and elevating means for vertically moving the rod assembly;

wherein the valve body comprises an upper housing connected to a lower portion of the concentrated ink tank, and a bobbin having one end fixed to the upper housing and another end connected to the developing solution tank to define a pipeline; and wherein the elevating means comprises an operation bar integrally connected to a center portion of the rod, and a plunger disposed in the bobbin so as to be vertically movable along an inner circumferential surface of the bobbin, and having a stepped portion formed on an inner side for supporting ends of the operation bar.

2. The ink feeding valve of claim 1, wherein the valve body further comprises:

an outer casing for covering the bobbin.

3. The ink feeding valve of claim 2, wherein the elevating means further comprises:

a solenoid disposed between the outer casing and the bobbin for elevating the plunger by receiving electric current;

a solenoid head formed on an upper inner side of the bobbin at a predetermined distance from the plunger for restricting movement of the plunger; and a spring disposed between the upper housing and the operation bar for elastically biasing the operation bar downwardly.

4. An ink feeding valve of a wet type electrophotographic printer for selectively feeding concentrated ink held in a concentrated ink tank to a developing solution tank, comprising:

a valve body having a pipeline for interconnecting the concentrated ink tank and the developing solution tank;

a rod assembly disposed in the pipeline of the valve body and vertically movable in the pipeline for selectively opening and closing the pipeline;

an elevating section for vertically moving the rod assembly; and a corrugated tube disposed in the pipeline of the valve body for partitioning the pipeline into an inside ink passage and an outside elevating section operating chamber, and for blocking ink flow into the elevating section operating chamber.

5. The ink feeding valve as claimed in claim 4, wherein the valve body comprises:

an upper housing connected to a lower portion of the concentrated ink tank, the upper housing having a boss downwardly extending from the upper housing, the boss having an ink inlet formed on a center thereof for forming an ink passage;

a bobbin having one end fixed to the upper housing and another end connected to the developing solution tank for forming a pipeline; and an outer casing disposed to cover an outer side of the bobbin.

6. The ink feeding valve as claimed in claim 5, wherein the rod assembly comprises:

a rod;

a first shutter disposed on an upper portion of the rod for selectively opening and closing the ink inlet by movement of the rod; and a second shutter disposed on a lower portion of the rod to close a lower opening of the ink passage when the ink inlet is opened by movement of the rod so as to define a space of a predetermined volume in the ink passage;

wherein ink is fed to the developing solution tank when the lower opening of the ink passage is opened by the second shutter only after a predetermined amount of ink from the concentrated ink tank fills the space of the ink passage.

7. The ink feeding valve as claimed in claim 6, wherein the elevating section comprises:

an operation bar integrally connected to a center portion of the rod, the operation bar being located in the outside elevating section operating chamber after being passed through the corrugated tube;

a plunger disposed in the bobbin so as to be vertically movable along an inner circumferential surface of the bobbin, the plunger having a stepped portion formed on an inner side for supporting ends of the operation bar;

a solenoid disposed between the outer casing and the bobbin for upwardly driving the plunger by receiving electric current;

a solenoid head formed on an upper inner side of the bobbin at a predetermined distance from the plunger for restricting movement of the plunger; and a spring disposed between the upper housing and the operation bar for elastically biasing the operation bar downwardly.

8. The ink feeding valve as claimed in claim 6, wherein the corrugated tube has an upper end connected to an end of the boss, and a lower end fitted into a projection inwardly protruding from a lower side of the bobbin.

9. The ink feeding valve as claimed in claim 8, wherein the corrugated tube comprises at least two inwardly folded portions which are in symmetrical relation to the operation bar disposed therebetween, the folded portions being formed such that one folded portion contracts when the other folded portion extends.

10. The ink feeding valve as claimed in claim 9, wherein the corrugated tube has a diameter that allows a gap of at least 2 mm between an extreme inner end of the folded portion and the rod.

11. An ink feeding valve of a wet type electrophotographic printer for selectively feeding concentrated ink held in a concentrated ink tank to a developing solution tank, comprising:

an upper housing connected to a lower portion of the concentrated ink tank, the upper housing having a boss downwardly extending from the upper housing, the boss having an ink inlet formed on a center thereof for forming an ink passage;

a bobbin having one end fixed to the upper housing and another end connected to the developing solution tank for forming a pipeline;

a rod vertically movable within the ink passage, the rod having a first shutter and a second shutter for selectively opening and closing the ink inlet;

an operation bar integrally connected to a center portion of the rod;

a plunger vertically movable along an inner circumferential surface of the bobbin, the plunger having a stepped portion for supporting ends of the operation bar;

a solenoid disposed outside the bobbin for upwardly driving the plunger by receiving electric current;

a solenoid head disposed in an upper inner side of the bobbin at a predetermined distance from the plunger for restricting movement of the plunger;

a spring disposed between the upper housing and the operation bar for elastically biasing the operation bar downwardly; and a corrugated tube vertically extending between an end of the boss and a projection inwardly protruding from a lower side of the bobbin for preventing ink flow into a place where the plunger and the spring are disposed.

12. An ink feeding valve of a wet type electrophotographic printer for selectively feeding concentrated ink reserved in a concentrated ink tank to a developing solution tank, comprising:

an upper housing connected to a lower portion of the concentrated ink tank, the upper housing having a boss downwardly extending from the upper housing, the boss having an ink inlet formed on a center thereof for forming an ink passage;

a bobbin having one end fixed to the upper housing and another end connected to the developing solution tank for forming a pipeline;

a rod vertically movable within the ink passage, the rod having a first shutter and a second shutter mounted thereon for selectively opening and closing upper and lower openings of the ink passage;

a plunger-operation bar integration connected to a center portion of the rod, the plunger-operation bar integration having a respective plunger integrally formed on each of two ends thereof;

a solenoid disposed outside the bobbin for upwardly driving said respective plungers by receiving electric current;

a spring disposed between the upper housing and the operation bar for elastically biasing the operation bar downwardly; and a corrugated tube vertically extending between an end of the boss and a projection inwardly protruding from a lower side of the bobbin for preventing ink flow into a place where the plunger and spring are disposed.

13. The ink feeding valve as claimed in claim 12, further comprising an outer casing disposed around the bobbin to cover the solenoid.

14. An ink feeding valve of a wet type electrophotographic printer for selectively feeding concentrated ink reserved in a concentrated ink tank to a developing solution tank, comprising:

an upper housing connected to the concentrated ink tank, the upper housing having an ink inlet for forming an ink passage;

a lower housing connected to the developing solution tank, the lower housing having an ink outlet;

a bobbin connected between the upper and lower housings, the bobbin having a pipeline for interconnecting the ink inlet and the ink outlet;

a rod vertically movable in the pipeline of the bobbin, the rod having a shutter disposed on an upper portion thereof for selectively opening and closing the ink inlet of the upper housing, and the rod having a connecting portion formed on a lower portion thereof and having a plurality of ink passing holes;

a cylindric partition vertically extending downwardly from the connecting portion of the rod for partitioning the pipeline of the bobbin into an inside ink passage and an outside elevating section operating chamber;

a plunger vertically movable along an inner circumferential surface of the bobbin, the plunger having a stepped portion formed at a certain inner location for supporting ends of the operation bar;

a solenoid disposed outside the bobbin for upwardly driving the plunger when receiving electric current;

a solenoid head disposed around an upper inner side of the bobbin at a predetermined distance from the plunger for limiting movement of the plunger;

a spring disposed between the stepped portion and the solenoid head for elastically biasing the plunger downwardly; and a corrugated tube vertically extending between the upper housing and a lower side of the bobbin for preventing ink flow into a place where the plunger and spring are disposed.

15. The ink feeding valve as claimed in claim 14, further comprising an outer casing disposed around the bobbin to surround the solenoid.

16. The ink feeding valve as claimed in claim 14, further comprising a sealing member integrally formed around an upper end of the corrugated tube for maintaining a sealing status.

17. The ink feeding valve as claimed in claim 14, further comprising a sealing pad disposed on the connecting portion and the bobbin for maintaining a sealing status.

18. The ink feeding valve as claimed in claim 14, wherein the upper housing has a boss and the bobbin has a projection protruding from a lower side thereof, and wherein the corrugated tube extends between an end of the boss and the projection.

19. An ink feeding valve of a wet type electrophotographic printer for selectively feeding concentrated ink reserved in a concentrated ink tank to a developing solution tank, comprising:

a valve body having a pipeline interconnecting the concentrated ink tank and the developing solution tank; and shutter means disposed on the pipeline of the valve body for selectively opening and closing the pipeline;

wherein the shutter means comprises a rod, a first shutter disposed on an upper portion of the rod for selectively opening and closing an upper opening of the pipeline, and a second shutter disposed on a lower portion of the rod for opening and closing a lower opening of the pipeline;

wherein the lower opening is closed when the upper opening of the pipeline is opened so as to define a space of a predetermined volume on the pipeline; and wherein the valve body comprises an upper housing connected to a lower portion of the concentrated ink tank, the upper housing having a boss which has an ink inlet and which downwardly extends from a center of the upper housing, and a bobbin having one end fixed to the upper housing and another end connected to the developing solution tank to define a pipeline.

20. The ink feeding valve of claim 19, wherein the valve body further comprises:

an outer casing for covering the bobbin.

21. An Ink feeding valve of a wet type electrophotographic printer for selectively feeding concentrated ink reserved in a concentrated ink tank to a developing solution tank, comprising:

a valve body having a pipeline interconnecting the concentrated ink tank and the developing solution tank; and shutter means disposed on the pipeline of the valve body for selectively opening and closing the pipeline;

wherein the shutter means comprises a rod, a first shutter disposed on an upper portion of the rod for selectively opening and closing an upper opening of the pipeline, and a second shutter disposed on a lower portion of the rod for opening and closing a lower opening of the pipeline;

wherein the lower opening is closed when the upper opening of the pipeline is opened so as to define a space of a predetermined volume on the pipeline; and wherein said shutter means further comprises a moving section for moving the rod vertically so as to selectively open and close the upper and lower openings, respectively.

22. The ink feeding valve of claim 1, wherein said rod assembly includes:

a rod;

a first shutter disposed on an upper portion of the rod for selectively opening and closing an upper opening of the pipeline; and a second shutter disposed on a lower portion of the rod for closing a lower opening of the pipeline when the upper opening of the pipeline is opened by an elevating movement of the rod so as to define a space of a predetermined volume on the pipeline.

23. The ink feeding valve of claim 21, wherein the valve body comprises:

an upper housing connected to a lower portion of the concentrated ink tank, the upper housing having a boss which has an ink inlet and which downwardly extends from a center of the upper housing;

a bobbin having one end fixed to the upper housing and another end connected to the developing solution tank to define a pipeline; and an outer casing for covering the bobbin.

* * * * *